US006062227A

United States Patent [19]

Kuenzel

[11] Patent Number: 6,062,227

[45] Date of Patent: May 16, 2000

[54] FINGER-OPERATED REFUSE-RETAINING CIGAR HEAD CUTTER

[76] Inventor: Kurt I. Kuenzel, Apt. A5, 7655 Whispering Brook Dr., Portage, Mich. 49002

[21] Appl. No.: 09/247,172

[22] Filed: Feb. 9, 1999

[51] Int. Cl.[7] ..... A24F 13/20; A24F 13/24; A24C 1/24; B26D 7/00

[52] U.S. Cl. ..... 131/248; 131/250; 30/113; 30/111; 30/109; 83/167

[58] Field of Search ..... 131/248, 250, 131/250.1, 252, 253, 233; 30/109, 111, 113, 278, 279.2; 99/635; 83/167, 931

[56] References Cited

U.S. PATENT DOCUMENTS

| | | | |
|---|---|---|---|
| Re. 13,873 | 2/1915 | Emrich | 110/234 |
| 236,679 | 1/1881 | Kaufmann | 30/112 |
| 5,715,602 | 2/1998 | Hage | 30/113 |

FOREIGN PATENT DOCUMENTS

| | | | |
|---|---|---|---|
| 34647 | 9/1885 | Germany | 30/113 |

*Primary Examiner*—Stanley S. Silverman
*Assistant Examiner*—Dionne A. Walls
*Attorney, Agent, or Firm*—The Firm of Gordon W. Hueschen

[57] ABSTRACT

A finger-operated refuse-retaining cigar head cutter comprising a body member, an opening in one side of the body member sized to permit insertion of a cigar head to be cut, and refuse-retention structure in the body member opposite said opening, a cutting blade track in the body member, and a finger-operated cutting blade slidably disposed and retained in the track, the finger-operated cutting blade being moveable from an extended position to a closed position between the opening and the refuse-retention structure, whereby, upon inserting a cigar head into the opening and into the refuse-retention structure and cutting the head of the cigar by bringing the finger-operated cutting blade from an extended position into the closed position, the cigar head is cut and refuse from cutting the cigar head is retained in the refuse-retention structure by the cutting blade until the cutting blade is moved out of the closed position. The cutter may be single- or double-bladed and is equally operative with pointed-head, round-head, and flat-head cigars.

18 Claims, 6 Drawing Sheets

Fig. 1
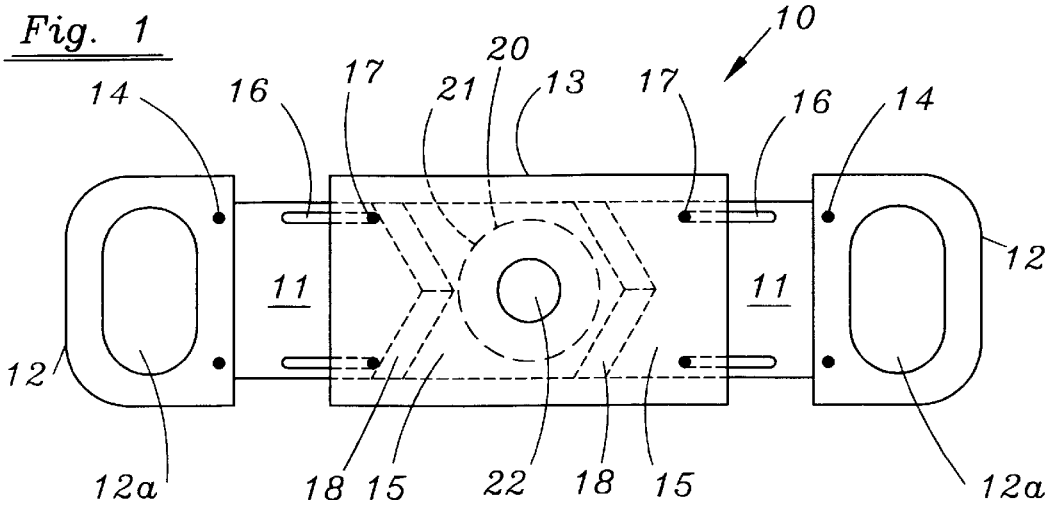
Fig. 2
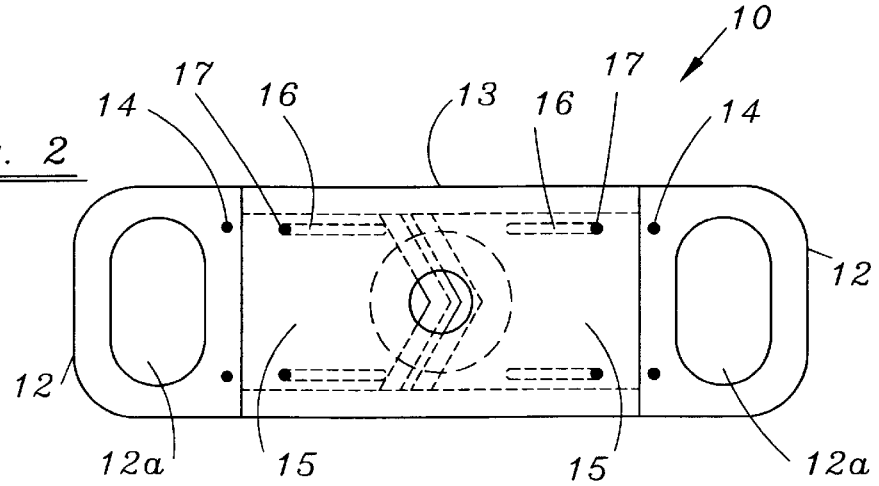
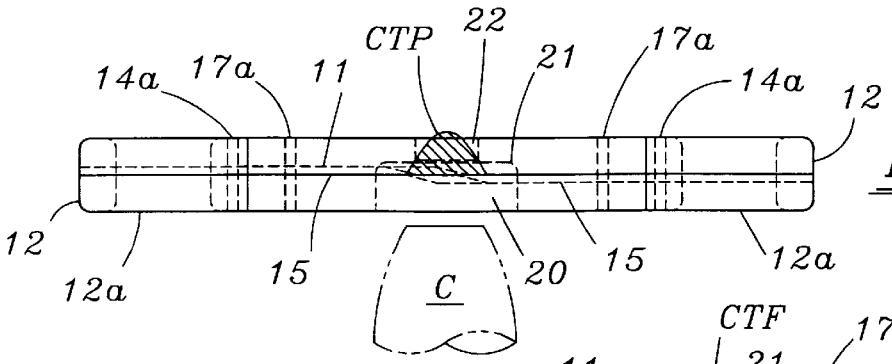
Fig. 3A
Fig. 3B
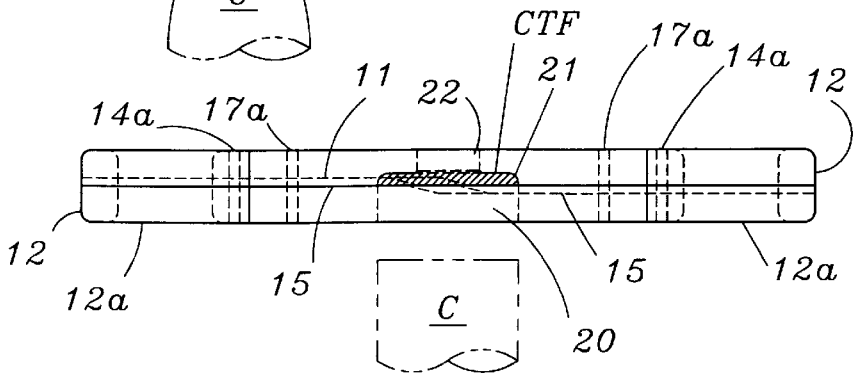

FINGER-OPERATED REFUSE-RETAINING CIGAR HEAD CUTTER

FIELD OF THE INVENTION

Finger-operated cigar head cutters.

BACKGROUND OF THE INVENTION AND PRIOR ART

Cigars have long been popular and have recently experienced renewed interest on the part of smokers. With this renewed interest comes the need for an improved cigar-head cutter, especially one which retains the cut piece of the cigar, i.e., the leavings, debris, or refuse, until it can be released over a suitable receptacle such as an ashtray or the like and which therefore does not permit the cut piece of the cigar to fall or fly upon cutting with the normal consequence of contaminating the immediate environment.

The prior art is replete with cigar head cutters of various types, including finger-operated types, but none of these have the above-identified advantage of the present cigar head cutter and none of them embody the structural features, especially the refuse-retention feature, incorporated in the finger-operated cigar head cutter of the present invention or suggest any means for attaining refuse retention.

OBJECTS OF THE INVENTION

It is an object of the present invention to provide a unique and advantageous finger-operated cigar head cutter, either single-bladed or double-bladed, comprising means or structure for retaining the portion cut from the cigar head, i.e., the refuse, within the cutter until the cut cigar is removed from the cutter and the blade or blades retracted from their closed or finished-cut position, thus enabling the refuse, i.e., the cut portion or piece of the cigar, to be disposed of in a sanitary manner. Another object of the invention is to provide such a cutter which can be manipulated with a single hand and in which the blade is attached either to a single finger grip or handle or in which two opposed blades are attached to two finger grips or handles. A further object of the invention is to provide such a cutter which automatically controls the depth of the cut and which then permits convenient ejection of the cut portion of the cigar upon withdrawing the cutting blade or blades from the finished-cut or closed position.

Other objects of the invention will become apparent to one skilled in the art and still others will become apparent from a reading of the Specification which follows.

SUMMARY OF THE INVENTION

What I believe to be my invention, then, inter alia, comprises the following, alone or in combination, and may be summarized as follows:

A finger-operated refuse-retaining cigar head cutter comprising a body member, an opening in one side of said body member sized to permit insertion of a cigar head to be cut, and refuse-retention means in said body member opposite said opening, a cutting blade track in said body member, and a finger-operated cutting blade slidably disposed and retained in said track, the finger-operated cutting blade being moveable from an extended position to a closed position between said opening and said refuse-retention means, whereby, upon inserting a cigar head into said opening and into said refuse-retention means and cutting said head of said cigar by bringing said finger-operated cutting blade from an extended position into said closed position, the cigar head is cut and refuse from cutting said cigar head is retained in said refuse-retention means by said cutting blade until said cutting blade is moved out of said closed position, such a cigar head cutter wherein said opening in one side of said body member is a first opening and wherein said refuse-retention means comprises a connected second and smaller opening in the other side of said body member, said connected second opening being sized to permit insertion of the pointed tip of a pointed-head cigar thereinto when the cigar head is inserted in said first opening, for retention of the refuse, from cutting off the end of a cigar having a pointed head, when inserted in said first opening and said second opening, by means of said cutting blade and said second and smaller opening in said body member until said blade is moved out of closed position, such a cigar head cutter wherein said refuse-retention means is a recess in said body member on the side of said blade opposite from said opening, for retention of the refuse, from cutting off the end of a cigar having a flat or rounded head, when inserted in said opening and into said recess, by means of said cutting blade and said recess in said body member until said blade is moved out of closed position, such a cigar head cutter wherein said refuse-retention means comprises both a connected and smaller second opening in the other side of said body member and sized to permit insertion of the pointed tip of a pointed head cigar and a recess in said body member on the side of said blade opposite from said opening, such a cigar head cutter comprising first and second finger-operated cutting blades, which are finger operated from opposite ends of said body member, each in a blade track within said body member, such a cigar head cutter wherein said cutting blade is flat in cross section, or V-shaped in cross section, or is flat with a V-shaped notch, such a cigar head cutter wherein said cutting blade has a V-shaped cutting edge, such a cigar head cutter comprising first and second finger-operated cutting blades, which are finger operated from opposite ends of said body member, each in a blade track within said body member, such a cigar head cutter wherein said first cutting blade has a V-shaped cutting edge and said second cutting blade has an inverted V-shaped cutting edge, such a cigar head cutter wherein the cutting edges of said blades are arranged to slip past each other beneath said second and smaller opening and beneath said recess, such a cigar head cutter wherein the cutting edges of said blades have opposite bevels, such a cigar head cutter wherein said body member also comprises, at an end thereof adjacent said first opening and at an end of said body member adjacent said cutting blade when in closed position, a clean-out opening for clearing out debris which may have been left upon emptying refuse from said second opening or said recess after moving said blade out of closed position, such a cigar head cutter wherein said body member comprises a top plate and a bottom plate, said plates being secured together, said smaller second opening being provided in said top plate, said recess being provided in the bottom of said upper plate, and said first opening being provided in said bottom plate, such a cigar head cutter wherein said plates are secured together by pins which also extend through slots in said blade to slidably retain said blade within said body member, such a cigar head cutter comprising a top plate and a bottom plate, said plates being secured together, said smaller second opening being provided in said top plate, said recess being provided in the bottom of said top plate, and said first opening being provided in said bottom plate, and, finally, such a cigar head cutter wherein said plates are secured together by pins which also extend through slots in said blades to slidably retain said blades within said body member.

DESCRIPTION OF THE DRAWINGS

Reference is now made to the drawings wherein:

FIG. 1 is a top plan view of a two-bladed cutter of the invention showing the blades and the blade track or race in shadow lines with the blade handles in extended or open position and showing the pins for holding the top and bottom portions, sections, or plates of the body of the device together as well as extending through blade slots, thus serving to restrain the blades from becoming disconnected from the body, and additional pins securing the blade handles to the blades.

FIG. 2 is the same as FIG. 1 with the blades in closed or finished cut position.

FIG. 3A is a side elevation of the device of FIG. 2 in the same position as in FIG. 2 with the various elements being indicated in shadow lines and with the residue or refuse cut from a pointed-head cigar also being shown in shadow lines, and showing the overlapping blades in their races or tracks and with the cut cigar being removed from the cutter of the invention.

FIG. 3B is a side elevation of the device of FIG. 2 in the same position as in FIG. 2 with the various elements being indicated in shadow lines and with the residue or refuse cut from a flat-head or rounded-head cigar also being shown in shadow lines, and showing the overlapping blades in their races or tracks and with the cut cigar being removed from the cutter of the invention.

FIG. 18B is the same as FIG. 18A except that the cigar is a flat-head or round-head cigars FIGS. 19, 20, 22, 23; and 25 are the same as FIGS. 4, 6, 8, 10, and 12, except for a single-blade cutter.

DESCRIPTION OF THE PREFERRED EMBODIMENTS

Figure 4:
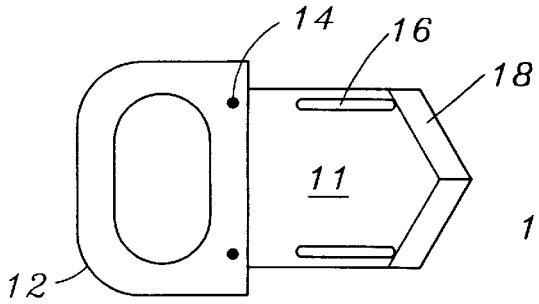
FIG. 4 is a plan view of the left-hand blade with handle attached showing the V-shaped cutting edge of the blade and the slots whereby the blade is maintained in its proper track inside the body of the device.

Reference is now made to the drawings, wherein the elements are numbered consecutively and wherein the same numbers or numbers separated by 100 are used to refer to the same elements throughout.

Referring now to FIG. 1, the assembled cutter in one embodiment is generally shown at 10, having body member 13 and smaller central circular or figurado aperture 22, through which the head of a pointed cigar may protrude when a cigar is inserted from the bottom of the device through opening 20, and within which two fully open or extended cutting blades 11 are slidably mounted, each within its respective raceway, race, or track, for cutting off the tip of a cigar inserted into the device from below. Each cutting blade 11 is secured within blade track 15 by means of pins 17 through slots 16, which pins not only retain blades 11 within body 13 but also secure top and bottom portions, sections, or plates 13T and 13B of the device together, along with whatever cement or adhesive may also be employed. Blades 11 are in turn secured to handles 12 by means of pins 14, each handle 12 being provided with a finger hole 12*a*. Shown in shadow lines are blade tracks 15 and V-shaped blade cutting edge 18 and its corresponding inverted V-shaped cutting edge 18, and centering recess or indentation 21 which is only present in the bottom of the upper or top section, portion, or plate 13T of said device, as well as larger bottom opening 20.

In FIG. 2 is shown the cutter of the invention with cutting blades 11 in finished cut or closed position, with cutting edges 18 in close and overlapping juxtaposition, each in its own track, which is the position of the blades upon having cut the head of a cigar inserted into said device.

In FIGS. 3A and 3B, which are side elevations of this embodiment of the cutter of the invention with various elements thereof shown in shadow lines, the cut cigar C is shown being withdrawn from larger bottom aperture 20 of the cutter, with the refuse, i.e., the pointed head CTP of the cigar as cut therefrom, being retained in the smaller circular or "figurado" aperture 22 by closed blades 11 therebeneath. FIG. 3B is the same as 3A except that, in this case, the cigar involved has a flat or rounded head and the cut portion CTF thereof, i.e., the refuse, is retained in centering recess or indentation 21 by means of closed blades 11 therebeneath, each in its respective blade track 15.

The overall dimensions of this double-blade cutter of the invention may, for example, be about 0.438 inch thick, about 1.375 inches wide, and about 4.375 inches long in closed position, with the distance between the center lines of the finger holes 12*a* being about 3.375 inches whereas, in open position, the overall length may be about 5.459 inches and the distance between the center lines of the finger holes 12*a* may be about 4.459 inches.

Figure 5:
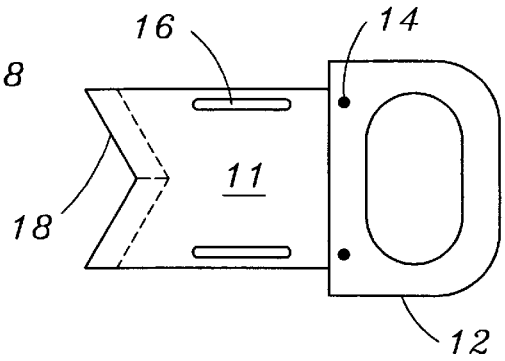
FIG. 5 is the same as FIG. 4 except that it depicts the right-hand blade and blade handle and shows the cooperating inverted V-shaped cutting edge of the blade.
Figure 6:
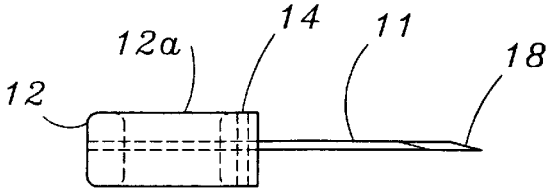
FIG. 6 is a side elevation of the blade and blade handle of FIG. 4 with the various elements being shown in shadow lines.
Figure 7:
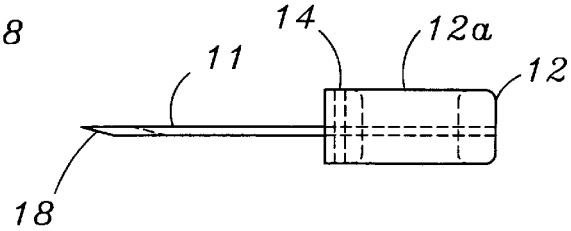
FIG. 7 is a side elevation of the blade and blade handle of FIG. 5 with the various elements being shown in shadow lines.

FIG. 4 shows the left-hand blade and handle whereas FIG. 5 shows the right-hand blade and handle, FIGS. 6 and 7 showing respectively the side elevations corresponding to FIGS. 4 and 5, it being noted that cutting edge 18 of the left-hand blade 11 is preferably beveled the reverse of cutting edge 18 on the right-hand blade 11 so that the cutting edges may overlap each other slightly when the cutter is in closed position and give a clean cut to the cigar head inserted into the cutter. As shown, the bevels are especially suitable for a structure wherein the right-hand blade passes beneath the left-hand blade during the cutting operation.

Figure 8:
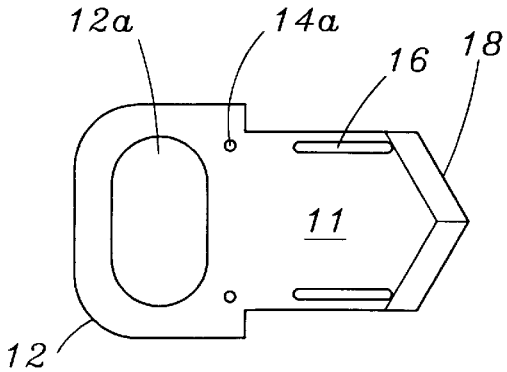
FIG. 8 is a plan view of the blade of FIGS. 4 and 6.
Figure 9:
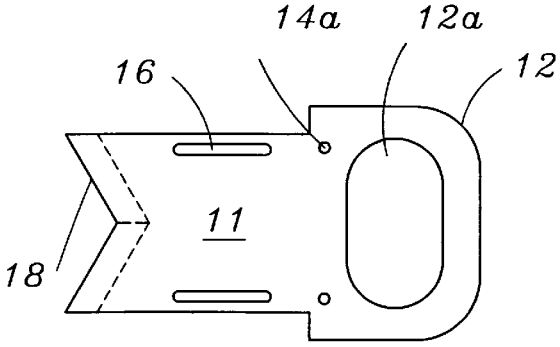
FIG. 9 is a plan view of the blade of FIGS. 5 and 7.
Figure 10:
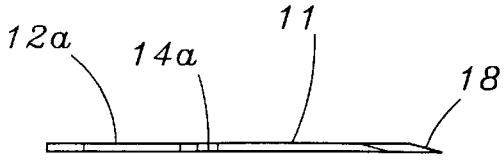
FIG. 10 is a side elevation of the blade of FIGS. 4, 6, and 8.
Figure 11:
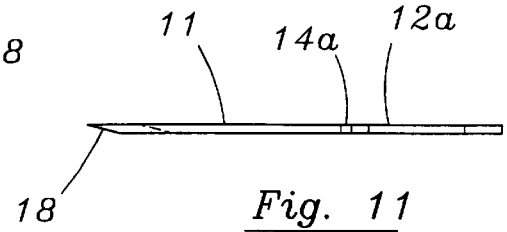
FIG. 11 is a side elevation of the blade of FIGS. 5, 7, and 9.

FIGS. 8 and 9 as well as FIGS. 10 and 11 show the cutting blades 11 in top plan view and side elevation without the handle 12 attached thereto, having apertures 14*a* for the insertion of retaining pins 14 therethrough.

Figure 12:
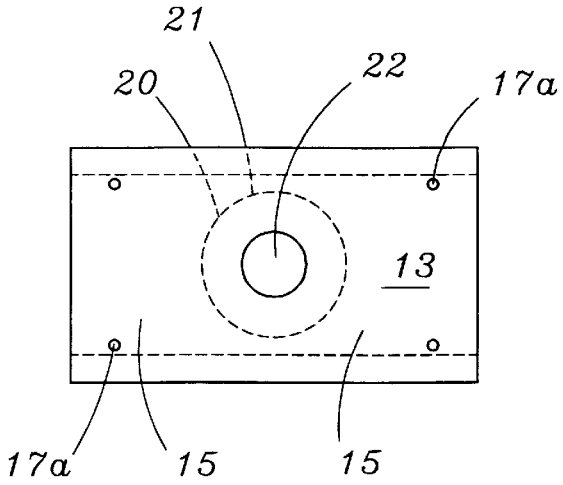
FIG. 12 is a top plan view of the body of the cutter of the invention showing the upper central opening and showing the blade track or raceway and the centering indentation or recess as well as the bottom opening in shadow lines. The plan view of the bottom of the device of the invention is identical to that of FIG. 12 except that the centering indentation or recess and the bottom-opening would not be shown in shadow lines, as seen from FIG. 13.

FIG. 12 shows a top view of the body 13 of the cutter, with smaller central or figurado opening 22 in top plate or section 13T, and in shadow lines the centering recess 21 in the bottom of top plate or section 13T for use when cutting the head of a flat-head or round-head cigar (as opposed to a figurado or pointed-head cigar), along with blade races or tracks 15 therein. From FIG. 13 can again be seen overlapping blade tracks 15 to permit overlapping of the blades 11 when in closed position as well as overlap of blades 11 beneath smaller top or figurado opening 22 as well as beneath centering recess or indentation 21. As seen, larger bottom opening 20 in bottom plate or section 13B corresponds in its circumferential dimension to recess 21.

The respective top and bottom sections, portions, or plates 13T and 13B are held together by pins 17 in pin apertures 17*a* which also retain blades 11 in body member 13 by passing through blade slots 16 as shown in FIGS. 1, 4, and 8, and may also be held together by the employment of any suitable glue, adhesive, or cement as required or desired.

Figure 13:
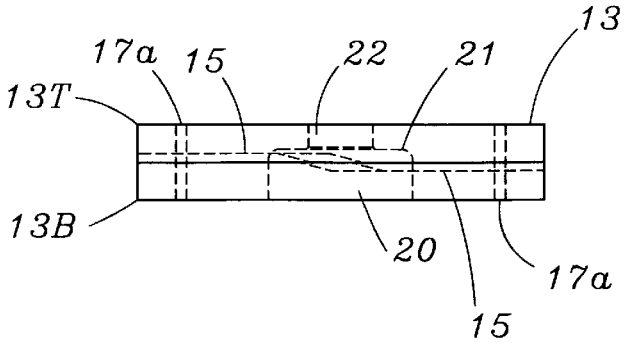
FIG. 13 is a side elevation of the cutter body of FIG. 12 with the elements shown in shadow lines, showing the top and bottom portions or plates, upper and lower openings, the intermediate recess, and including the overlapping blade raceways or tracks.
Figure 14:
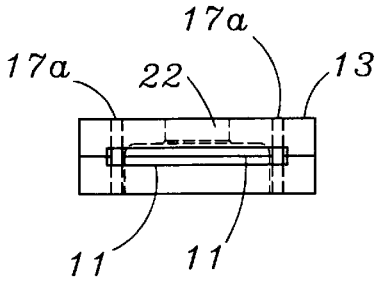
FIG. 14 is the same as FIG. 13 except that it is an end elevation of the cutter body of the invention.

In the side elevation of FIG. 13, blade tracks 15 and other internal elements are shown in shadow lines. In the end elevation of FIG. 14, everything is the same as in the side elevation of FIG. 13 except that the view is from the end of the cutter body member.

Figure 21A:
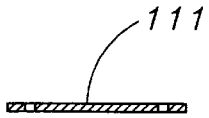
FIGS. 21A, 21B, and 21C are end views of the blade of FIG. 20, showing a flat blade, a V-shaped blade, and a flat blade with a V-notch.

The blades 11 and their cutting edges 18 in this two-bladed embodiment of the invention may be flat or notched or V-shaped as shown for the single-blade cutter embodiment in FIGS. 21A, B, C, and 24A, B, C, a correspondingly-shaped blade raceway or slot 15 being then provided in cutter body member 13, the blades 11 in any event being of complementary cross-section so as to be able to slip over each other between both recess 21 and smaller top opening 22, and larger bottom opening 20 at their cutting edges 18 as shown in FIGS. 3A and 3B and having correspondent raceways or blade tracks as shown in FIG. 13.

Figure 15:
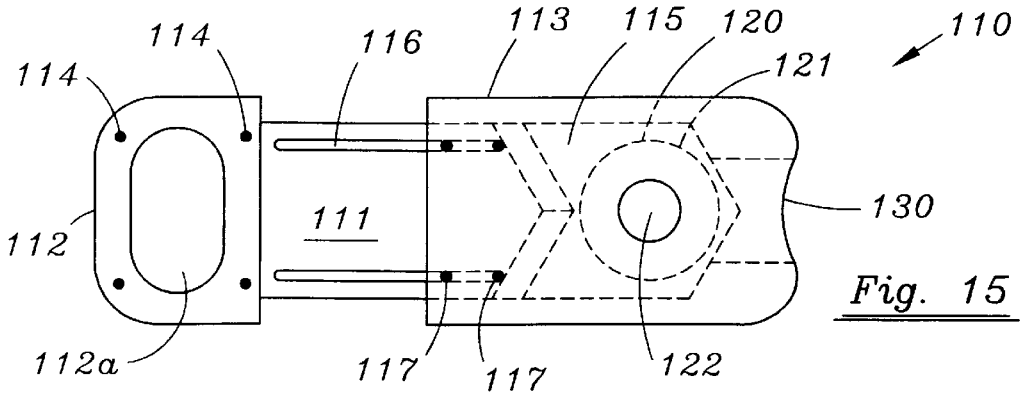
FIG. 15 is the same as FIG. 1 except that it depicts a single-blade cutter of the invention.
Figure 16:
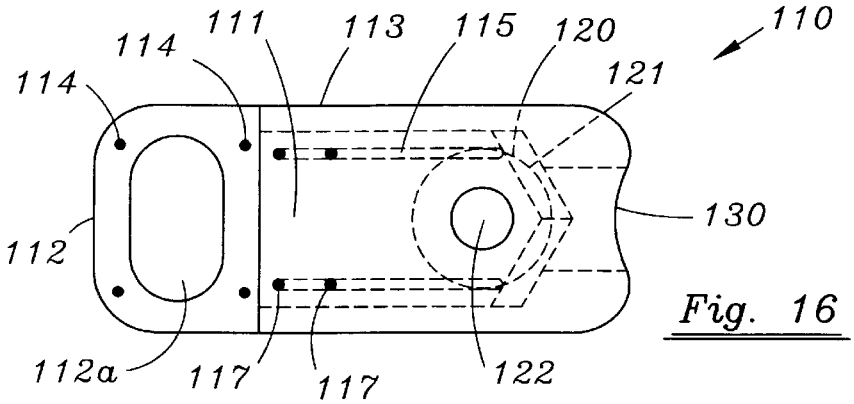
FIG. 16 is the same as FIG. 2 except that it depicts a single-blade cutter of the invention.

FIG. 15 is the same as FIG. 1 and FIG. 16 is the same as FIG. 2, except for the fact that the cutter 110 is shown in a single-blade embodiment and that a clean-out slot 130 is provided at an end of body member 113 opposite blade 111 and blade handle 112.

Figure 17:
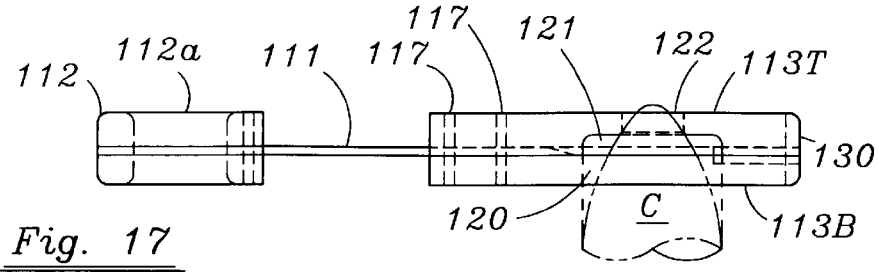
FIG. 17 is a side elevation of the cutter of FIG. 15 showing a pointed-head cigar inserted therein prior to closing the blade for cutting of the cigar head.

FIG. 17 shows the single-blade embodiment in open position with a cigar C inserted into the larger bottom hole, aperture, or opening 120 in the bottom section, portion, or plate 113B of the cutter body 113 whereas centering recess 121 for flat-head or round-head cigars is shown in top portion 113T as well as central circular or figurado aperture 122, with the tip of pointed-head or figurado cigar C extending into the smaller upper figurado or circular opening 122.

Figure 18A:
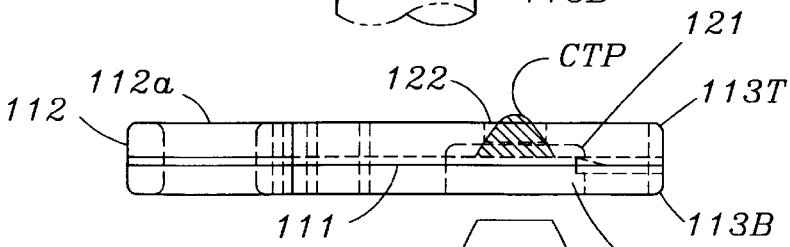
FIGS. 18A and 18B are the same as FIGS. 3A and 3B, respectively showing the end of a pointed-head cigar retained in the cutter of the invention with the cutter blade fully closed and with the cut cigar being removed from the cutter.
Figure 18B:
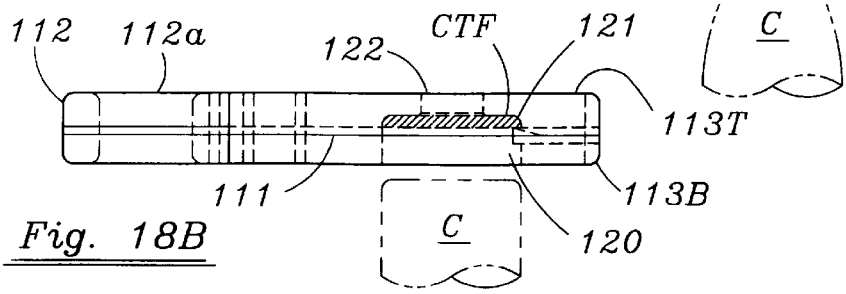

FIGS. 18A and 18B show the cut cigar C withdrawn from larger bottom hole, aperture, or opening 120, leaving the refuse, i.e., the cut piece CTP of the pointed cigar, in smaller upper circular or figurado opening 122 and secured there in place by closed blade 111. In FIG. 18B, the cut piece or refuse CTF from the flat-head or round-head cigar is left in centering recess or indentation 121, being held there in place by the closed blade 111 therebeneath after cigar C is withdrawn from larger lower opening 120.

Figure 19:
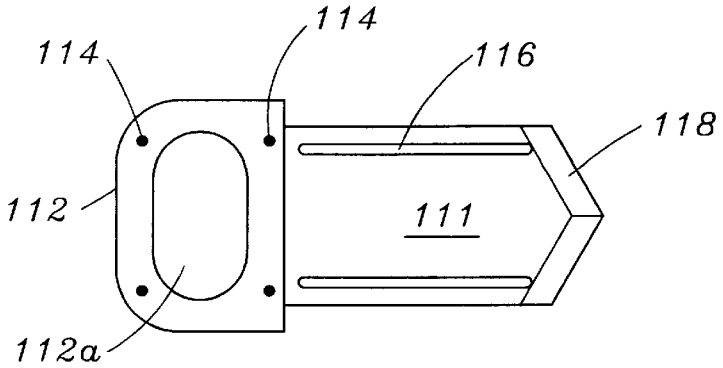
Figure 20:
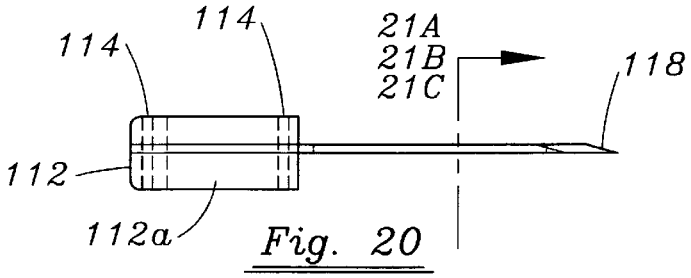
Figure 21B:
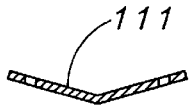
Figure 21C:
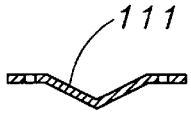

FIG. 19 is a plan view of the blade 111 of the single-blade cutter embodiment of the invention with finger handle 112 attached, whereas FIG. 20 is a side elevation of the same, and FIGS. 21A, 21B, and 21C are end cross-sectional views of the blade 111 in its flat, V-shaped, and notched shape, in each case requiring a suitably configured blade raceway, race, or track 115 for the slidable retention thereof within the cutter body 113.

Figure 22:
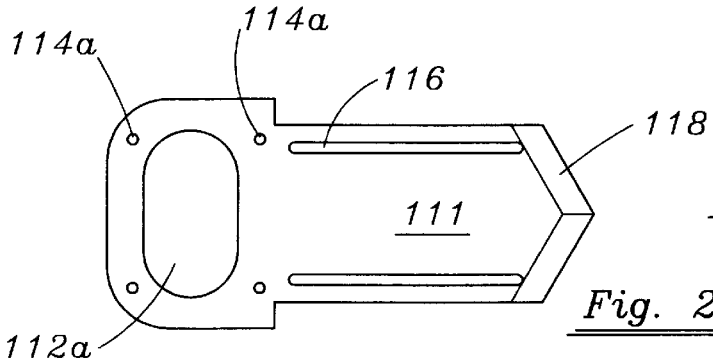
Figure 23:
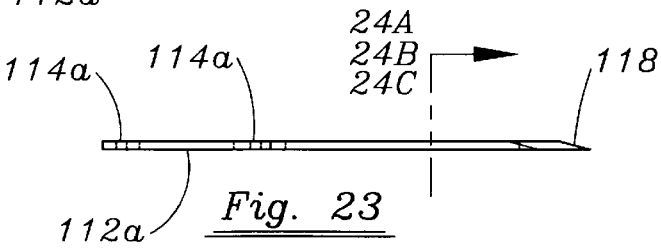
Figure 24A:
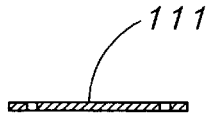
FIGS. 24A, 24B, and 24C are the same as 21A, 21B, and 21C, showing various possible end views of the blade of FIG. 23.
Figure 24B:
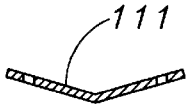
Figure 24C:
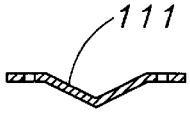

FIG. 22 is a plan view of the cutter blade 111 itself, sans top and bottom portions of the handle 112, again showing guide slots 116 and V-shaped cutting edge 118. FIG. 23 is a side elevation thereof, and FIGS. 24A, 24B, and 24C are end elevations of the blade showing the usual flat blade but also the optional V-shaped blade and V-notched or trenched blade as cross-sectional variations.

Figure 25:
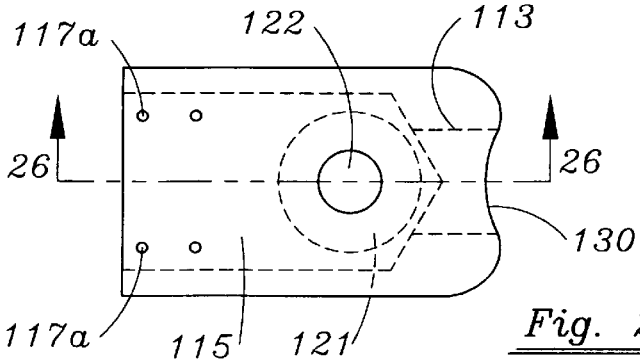
FIG. 25 is a top plan view of the body member of the cutter of FIGS. 15 and 16.

FIG. 25 is a top plan view of the body member 113 of the single-blade cutter 110 of the invention, including in shadow lines the blade raceway, race, or track 115, the centering recess or indentation 121, and the clean-out slot 130, whereas the upper circular or figurado aperture 122 is shown in solid lines.

Figure 26:
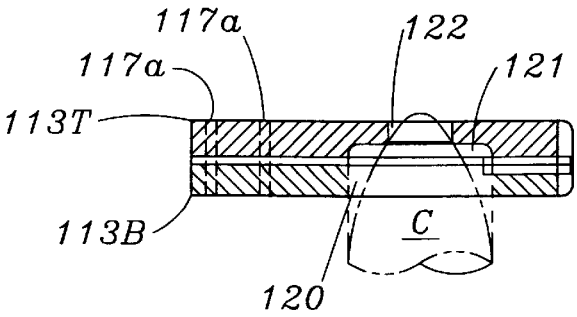
FIG. 26 is a cross section taken along the line 26—26 of FIG. 25, showing a pointed-head cigar inserted into the device and showing the outline of a flat-head cigar inserted in the device.

FIG. 26 is a cross section taken along line 26—26 of FIG. 25 and shows in cross section the top and bottom sections, portions, or plates 113T and 113B of the body member 113 of the single-blade cutter of the invention, with pointed-head cigar C inserted into larger opening 120 in bottom 113B thereof and extending through centering recess or indentation 121 and into the smaller circular or figurado aperture 122 in top section, portion, or plate 113T.

Figure 27:
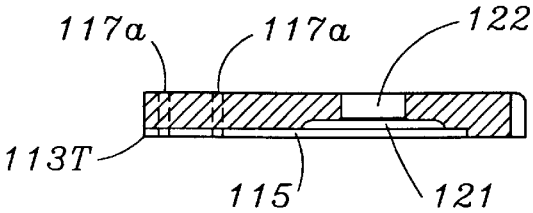
FIG. 27 is a cross section of the top portion or plate of the device as shown in FIG. 26, and showing the blade track or raceway.
Figure 28:
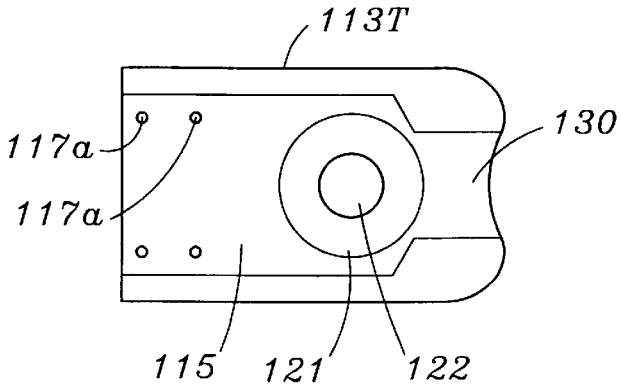
FIG. 28 is a plan view of the top plate of FIG. 27 as seen from the bottom thereof.
Figure 29:
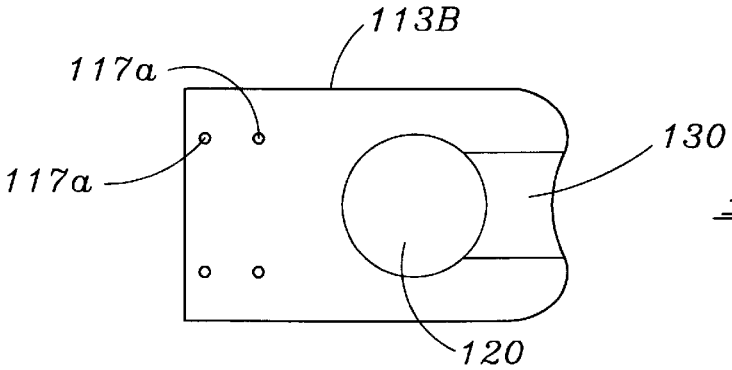
FIG. 29 is a plan view of the bottom section or plate of FIG. 26 as seen from the top.
Figure 30:
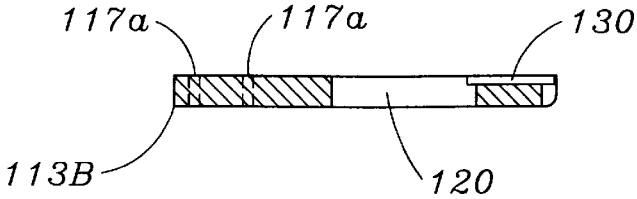
FIG. 30 is a cross-sectional view of the bottom portion or plate of FIGS. 26 and 29.

FIG. 27 shows the top portion, section, or plate 113T in cross section, the same as shown in FIG. 26, which is normally secured to bottom portion, section, or plate 113B, shown in FIG. 30, by pins 117 extending through pin apertures 117*a*, together with any desired cement, adhesive, or the like, said pin apertures 117*a* being clearly shown in FIGS. 27, 28, 29, and 30, which pins 117 also serve as retainers for blade 111 as they extend through blade-retaining slots 116 (FIGS. 15, 19, 22).

FIG. 28 shows the upper section, portion, or plate 113T as viewed from the bottom thereof, with cleaning slot 130, smaller figurado or circular aperture 122, and centering recess or indentation 121, as well as blade track 115, whereas FIG. 29 shows the bottom portion 113B of the single-blade cutter of the invention in plan view as viewed from the top thereof, with cleaning slot 130 and larger bottom hole, aperture, or opening 120 clearly visible therefrom, just as they are from the cross sectional view of FIG. 30.

The overall dimensions of this single-blade cutter of the invention may, for example, be about 0.438 inch thick, about 1.375 inches wide, and about 3.242 inches long in closed position, with the distance between the center line of the finger hole 12*a* to the other end of the device being about 2.742 inches whereas, in open position, the overall length may be about 4.25 inches and the distance between the center line of the finger hole 12*a* to the other end may be about 3.75 inches.

OPERATION

In operation, the finger-operated refuse-retaining cigar head cutter of the invention is simple, effective, and foolproof. Operation of the two embodiments depicted in the drawings is identical. The single-blade model is somewhat more compact for pocket carry and has an optional clean-out or clearing slot.

To operate either of the embodiments of the present invention, blade or blades 11,111 are extended from the cutter body 13,113 by means of the finger handle or handles 12,112, to expose the larger bottom hole 20,120. Flat-head or round-head cigars are inserted in larger bottom hole or aperture 20,120 until the head abuts against the centering recess or indentation 21,121. Pointed head or figurado cigars extend through the centering recess or aperture 21,121 and into the smaller circular or figurado aperture 22,122. Blade or blades 11,111 are then actuated to cut the head of the cigar by means of finger pressure. The cut piece or refuse from the cigar is retained within the space between the closed blade and the top inside surface of the top portion, section, or plate 13,113 of the cutter until the blade or blades are retracted from the closed position to an extended position, at which time the refuse is conveniently released over an ashtray or the like and falls out of the larger bottom hole or aperture 20,120. The optional clearing or clean-out slot 130 is provided to allow ready clearing of any accumulated tobacco crumbs by means of a toothpick or similar instrument, should that be necessary.

THE PRESENT INVENTION—IN GENERAL

The present invention provides a unique finger-operated refuse-retaining cigar head cutter comprising two opposed portions, sections, or plates including at their interface a cutting blade raceway, race, or track within which a cigar head cutting blade is slidably retained, together with a cutting blade attached to a finger grip or handle for moving the blade into cutting and closed position and withdrawing the blade from closed position into an extended position at which point the cigar head is inserted into the device. The bottom section or plate of the device is provided with a relatively larger aperture or opening for insertion of the cigar head thereinto and into a cutting position. The upper section or plate of the device is provided with an indentation or recess, generally circular in nature, for centering of the cigar head in cutting position with the head inserted into the device. The top plate or section is also provided with a smaller aperture or hole through which the pointed tip of a cigar may extend when inserted into the device and into cutting position. Thus, if the cigar has a flat or rounded head, it may be inserted into the device through the opening or aperture in the lower section or plate thereof and into the recess or indentation in the bottom of the upper section or plate. When the cutting blade is then actuated by finger pressure, the blade comes across the head of the cigar and cuts a thin slice or piece from the head thereof, which refuse is retained in said recess as long as the blade is in closed position, and from which it can readily be evacuated by withdrawing the blade to extended position over an ashtray, once the cut cigar has been removed from the device. Similarly, when the cigar has a pointed or figurado head, the head of the cigar may be inserted through the aperture in the bottom section or plate of the device and through the centering recess of the upper section or plate of the device and with its tip extending into or through the relatively smaller circumference aperture or opening to the outside provided in the upper section or plate of the device. Once again, the cut portion of the cigar, i.e., the refuse, is retained in the device so long as the blade is not withdrawn from closed position, and may readily be disposed of in an ashtray or the like by simply withdrawing the cutting blade from closed position after the cut cigar has been removed from the device.

The device may be provided with a single blade or with two cutting blades, each with its own appropriate blade handle or grip, and the cross section of the cutting blade may be flat, V-shaped, or slightly notched, as desired by the smoker from the standpoint of whether or not a notch is desired in the head of his cigar as opposed to a flat cut. Similarly, a convenient clean out-slot may be provided in the single blade device if desired. The action of the novel cigar head cutter of the present invention is exactly the same, whether a single-bladed or a two-bladed device is involved, the double bladed device having slightly offset raceways to allow an overlap of the blades when brought into cutting position, beneath the upper recess and smaller opening and above the relatively larger opening, and the cutting blade in a single blade device having a V-shaped cutting edge whereas, in a double-blade device, one of the opposed blades has a V-shaped cutting edge and the other blade has a corresponding inverted V-cutting edge for complete cooperation and coincidence between the cutting edges of the blades. In either case, the cut portion or refuse from the cigar is retained either within the centering recess of the upper section or plate of the device or in both the recess and the aperture of lesser circumference to the outside, depending upon whether the cigar head being cut is flat, rounded, or pointed, so that the cut portion of the cigar or refuse can readily be retained within the device while the cut cigar is withdrawn therefrom, and then readily disposed of in an ashtray or the like simply by withdrawing the blade or blades from the closed position and releasing the cut portion or refuse from the device.

The blade or blades in the device of the invention are made of metal and preferably of high carbon stainless steel, whereas the body of the device of the invention is made from any suitable material such as wood, bone, phenolic or other plastic or plastic laminate, or the like, as will be well understood by one skilled in the art.

It is to be understood that the present invention is not to be limited to the exact details of operation, or to the exact compounds, compositions, methods, procedures, or embodiments shown and described, as various modifications and equivalents will be apparent to one skilled in the art, wherefore the present invention is to be limited only by the full scope which can be legally accorded to the appended claims.

I claim:

1. A finger-operated refuse-retaining cigar head cutter comprising a body member, an opening in one side of said body member sized to permit insertion of a cigar head to be cut, and refuse-retention means in said body member opposite said opening, a cutting blade track in said body member, and a finger-operated cutting blade slidably disposed and retained in said track, the finger-operated cutting blade being moveable from an extended position to a closed position between said opening and said refuse-retention means, whereby, upon inserting a cigar head into said opening and into said refuse-retention means and cutting said head of said cigar by bringing said finger-operated cutting blade from an extended position into said closed position, the cigar head is cut and refuse from cutting said cigar head is retained in said refuse-retention means by said cutting blade until said cutting blade is moved out of said closed position, wherein said opening in one side of said body member is a first opening and wherein said refuse-retention means comprises a connected second and smaller opening in the other side of said body member, said connected second opening being sized to permit insertion of the pointed tip of a pointed-head cigar thereinto when the cigar head is inserted in said first opening, for retention of the refuse.

2. A finger-operated refuse-retaining cigar head cutter comprising a body member, an opening in one side of said body member sized to permit insertion of a cigar head to be cut, and refuse-retention means in said body member opposite said opening, a cutting blade track in said body member, and a finger-operated cutting blade slidably disposed and retained in said track, the finger-operated cutting blade being moveable from an extended position to a closed position between said opening and said refuse-retention means, whereby, upon inserting a cigar head into said opening and into said refuse-retention means and cutting said head of said cigar by bringing said finger-operated cutting blade from an extended position into said closed position, the cigar head is cut and refuse from cutting said cigar head is retained in said refuse-retention means by said cutting blade until said cutting blade is moved out of said closed position, wherein said refuse-retention means comprises both a connected and smaller second opening in the other side of said body member and sized to permit insertion of the pointed tip of a pointed head cigar and a recess in said body member on the side of said blade opposite from said opening.

3. The cigar head cutter of claim 2, comprising first and second finger-operated cutting blades, which are finger operated from opposite ends of said body member, each in a blade track within said body member.

4. The cigar head cutter of claim 2, wherein said cutting blade is flat in cross section.

5. The cigar head cutter of claim 2, wherein said cutting blade is V-shaped in cross section.

6. The cigar head cutter of claim 2, wherein said cutting blade is flat with a V-shaped notch.

7. The cigar head cutter of claim 2, wherein said body member comprises a top plate and a bottom plate, said plates being secured together, said smaller second opening being provided in said top plate, said recess being provided in the bottom of said upper plate, and said first opening being provided in said bottom plate.

8. The cigar head cutter of claim 3 wherein said body member comprises a top plate and a bottom plate, said plates being secured together, said smaller second opening being provided in said top plate, said recess being provided in the bottom of said upper plate, and said first opening being provided in said bottom plate.

9. The cigar head cutter of claim 2, wherein said cutting blade has a V-shaped cutting edge.

10. The cigar head cutter of claim 9, comprising first and second finger-operated cutting blades, which are finger operated from opposite ends of said body member, each in a blade track within said body member.

11. The cigar head cutter of claim 10, wherein said first cutting blade has a V-shaped cutting edge and said second cutting blade has an inverted V-shaped cutting edge.

12. The cigar head cutter of claim 11, wherein the cutting edges of said blades are arranged to slip past each other beneath said second and smaller opening and beneath said recess.

13. The cigar head cutter of claim 12, wherein the cutting edges of said blades have opposite bevels.

14. The cigar head cutter of claim 9, wherein said body member also comprises, at an end thereof adjacent said first opening and at an end of said body member adjacent said cutting blade when in closed position, a clean-out opening for clearing out debris which may have been left upon emptying refuse from said second opening or said recess after moving said blade out of closed position.

15. The cigar head cutter of claim 7, wherein said plates are secured together by pins which also extend through slots in said blade to slidably retain said blade within said body member.

16. The cigar head cutter of claim 8, wherein said plates are secured together by pins which also extend through slots in said blades to slidably retain said blades within said body member.

17. The cigar head cutter of claim 11, comprising a top plate and a bottom plate, said plates being secured together, said smaller second opening being provided in said top plate, said recess being provided in the bottom of said top plate, and said first opening being provided in said bottom plate.

18. The cigar head cutter of claim 17, wherein said plates are secured together by pins which also extend through slots in said blades to slidably retain said blades within said body member.

* * * * *